US006256908B1

(12) United States Patent
Warner

(10) Patent No.: US 6,256,908 B1
(45) **Date of Patent: *Jul. 10, 2001**

(54) TERRAIN-ENGAGING CLEAT FOR TRACTION ENHANCEMENT

(75) Inventor: Charles Bently Warner, San Francisco, CA (US)

(73) Assignee: Tubbs Snowshoe Company LLC, Stowe, VT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/294,517

(22) Filed: Apr. 20, 1999

Related U.S. Application Data

(63) Continuation-in-part of application No. 09/009,948, filed on Jan. 21, 1998, now Pat. No. 5,901,471.

(51) Int. Cl.[7] ..... A43B 5/00

(52) U.S. Cl. ..... 36/124; 36/7.7; 36/122; 36/59 R

(58) Field of Search ..... 36/122, 123, 124, 36/125, 7.7, 7.6, 59 R, 62

(56) References Cited

U.S. PATENT DOCUMENTS

| | | | | |
|---|---|---|---|---|
| 37,558 | | 1/1863 | Field . | |
| 754,577 | | 3/1904 | Laub . | |
| 919,118 | * | 4/1909 | Blacklock | 36/7.7 |
| 988,527 | | 4/1911 | Wiseman . | |
| 1,045,565 | | 11/1912 | Kirton et al. . | |
| 1,103,108 | * | 7/1914 | Van Wie | 36/7.7 |
| 1,116,179 | * | 11/1914 | Wallace | 36/7.7 |
| 1,200,658 | | 10/1916 | Senf . | |
| 1,230,118 | | 6/1917 | Clifford . | |
| 1,570,791 | | 1/1926 | Solarz . | |
| 1,728,783 | | 9/1929 | Chase . | |
| 2,317,647 | | 4/1943 | Simunds . | |
| 2,358,066 | | 9/1944 | Harvey . | |
| 2,401,891 | | 6/1946 | Smith . | |
| 2,579,143 | | 12/1951 | Fisher . | |
| 2,920,403 | | 1/1960 | L'Etoile . | |
| 2,932,096 | * | 4/1960 | Tavormina | 36/7.7 |
| 3,082,550 | * | 3/1963 | Foresman | 36/7.7 |
| 4,005,533 | | 2/1977 | Anderson . | |
| 4,353,172 | * | 10/1982 | Bryant | 36/7.6 |
| 4,620,375 | | 11/1986 | Wallace . | |
| 4,745,692 | | 5/1988 | Liao . | |
| 4,910,883 | | 3/1990 | Zock, Jr. . | |
| 5,253,437 | | 10/1993 | Klebahn . | |
| 5,440,827 | | 8/1995 | Klebahn . | |
| 5,687,491 | | 11/1997 | Klebahn . | |
| 5,699,630 | | 12/1997 | Klebahn . | |
| 5,787,612 | | 8/1998 | Mahoney . | |
| 5,823,563 | * | 10/1998 | Dubuque | 36/62 |
| 5,901,471 | | 5/1999 | Warner . | |
| 5,918,387 | | 7/1999 | Emerson . | |

FOREIGN PATENT DOCUMENTS

| | | |
|---|---|---|
| 3019129 | 12/1980 | (DE) . |
| 1189492 | 1/1958 | (FR) . |

* cited by examiner

*Primary Examiner*—M. D. Patterson
(74) *Attorney, Agent, or Firm*—Thomas M. Freiburger

(57) ABSTRACT

Crampon and snowshoe combinations are disclosed, wherein the crampon or terrain-engaging cleat can be a traditional ice crampon used on a rigid and essentially unbending boot, or a soft boot cleat which engages only the front portion of the boot, forward of the heel, permitting boot flexing. The snowshoe has in a toe or ball area a registry plate configured to engage with the crampon, preferably between depending teeth or other structure of the crampon, and preferably with a self-centering feature as the crampon is lowered down onto the registry plate. Once the cleat or crampon is fully engaged down against the plate, it is substantially locked in position against relative shifting or rotation, and lifting of the boot off the back of the crampon is restricted by clips or straps, preferably flexible straps extending up from the registry plate and securable to brackets or hooks on the crampon device. Specific configurations of cleats or crampons are also disclosed, for use with or without snowshoes.

20 Claims, 10 Drawing Sheets

TERRAIN-ENGAGING CLEAT FOR TRACTION ENHANCEMENT

This Application is a continuation-in-part of application Ser. No. 09/009,948, filed Jan. 21, 1998, now U.S. Pat. No. 5,901,471. In addition, this application incorporates by reference the disclosure of Ser. No. 9,948.

BACKGROUND OF THE INVENTION

This invention concerns traction enhancing cleats for attachment to boots or shoes, particularly for flexible boots or shoes, functioning as a soft-boot crampon engaged under the ball of the foot but not the heel. In another aspect, the invention concerns such a terrain-engaging cleat which, when worn on a boot, can be secured to a snowshoe by stepping into the snowshoe, serving as a front cleat for the snowshoe.

Crampons, ice creepers and cleats for attachment to boots or shoes are very well known. For example, see U.S. Pat. Nos. 37,558, 754,577, 988,527, 1,045,565, 1,200,658, 1,230,118, 1,570,791, 1,728,783, 2,317,647, 2,358,066, 2,401,891, 2,579,143, 2,920,403, 4,005,533, 4,620,375, 4,745,692, 4,910,883, 5,787,612; French Patent No. 1,189,492 and German Patent No. DE 30 19 129 A1.

Conventional crampons essentially comprise rigid boot attachments which attach to the bottom of a boot sole by bales forming part of the crampons. These technical terrain-engaging devices require a substantially rigid boot, stiff like a downhill ski boot, because the crampon does not have any appreciable flexibility which could bend with the bending of a flexible boot. A crampon of this general type is shown in the above U.S. Pat. No. 4,910,883, and is also shown in the copending application Ser. No. 9,948. The above U.S. Pat. No. 754,577 also shows an essentially rigid type of crampon device.

Various types of ice creepers or cleats have been proposed for use on flexible boots or shoes, as reflected in some of the patents listed above. U.S. Pat. Nos. 1,570,791, 1,728,783, 2,401,891, 2,579,143 and 4,005,533 all show such cleats or creepers which reside in the arch area of the shoe or boot, just ahead of the heel. The cleat devices of those patents are retained on the boots using straps. Some of these show angled teeth, including front teeth angled downwardly/forwardly and including teeth with faces obliquely angled so as to achieve some degree of lateral traction as well as fore/aft traction.

U.S. Pat. No. 988,527 shows a flexible shoe having a heel element and a separate toe element, both secured to the shoe and with a form of spikes, for use by carpenters, roofers, etc. to prevent the wearer from slipping.

U.S. Pat. No. 4,745,692 shows an anti-slip toe cleat device which has capability of pivoting or folding from one position to another. The hardware is permanently attached to the shoe, in the ball area.

U.S. Pat. No. 2,317,647 shows a strap-attachable ice creeper device which fits in the arch and ball area of the shoe or boot, with teeth positioned in the ball area of the foot. Some of the teeth are angled, and the cleat device apparently is useable on a flexible shoe or boot.

French Patent No. 1,189,492 discloses a simple form of ice creeper comprising a single strap that wraps around the toe area of the shoe or boot and which has, fitted onto the strap, two cleats side-by-side under the ball of the foot, each cleat having forward and rear racks of teeth.

U.S. Pat. No. 5,687,491, owned by the assignee of the present invention, describes a contoured footbed for the front portion of a boot, the footbed being on the top surface of a front claw or cleat of a snowshoe. That patent is incorporated herein by reference.

In climbing or steep terrain hiking in snowy and icy conditions, the climber often needs to switch from wearing snowshoes on the boots to crampons on the boots, and back to snowshoes as fields of deeper snow are again encountered. To change from ice crampons to snowshoes, the user normally has to release the crampon's bales from front and back of the boot, remove the crampons and stow them in or on a pack, take out a pair of snowshoes from the pack, with their relatively heavy toe harness assemblies and cleats, and secure the snowshoes to the boots using several harness straps. In conditions where deep snow and ice are alternately encountered, the hiker or climber would be much better served if the crampon teeth could serve as the cleats for the snowshoes, and this is a primary object of the invention.

U.S. Pat. No. 4,620,375 disclosed a snowshoe wherein the user's boot was secured to a binding on an ice crampon. The crampon had toe and heel cleats which passed down through openings in toe and heel areas of the snowshoe deck when the user's boot was pivoted to the heel-down position, so that the crampon cleats served as cleats for the snowshoe. A horizontal pivot pin had to be assembled through the snowshoe frame and the crampon binding.

The copending application Ser. No. 9,948 referenced above describes a snowshoe for receiving conventional crampons, the snowshoe having openings in its deck at front and rear. The snowshoe is adapted to receive a conventional crampon secured to a user's boot in a step-in arrangement which was designed to afford fast and efficient securement of the boot and crampon to the snowshoe. The crampon's teeth, both the front set and back set, then serve as snowshoe cleats. The snowshoe can quickly be removed from the boot and crampon when ice is encountered.

The described arrangement works well for those using rigid, full-boot crampons. However, there is also a need for a more versatile crampon or cleat, for use on a flexible boot which bends with walking of the user. In particular, there is a need for such a cleat which engages under only the ball area of the boot, using a harness which is conveniently secured to and removed from the boot. In addition, there is a need for such a soft-boot terrain-engaging cleat or crampon which has a further utility of engaging with a snowshoe having a dedicated receiving device in the front area of the snowshoe, to lock the cleat in position on the snowshoe firmly against rotation or looseness as in the system described above, and with the ability to conveniently engage the boot-attached cleat with the snowshoe and to easily remove it from the snowshoe.

SUMMARY OF THE INVENTION

In one aspect of the invention, a soft-boot cleat, serving as a toe-only crampon which engages under the ball of the foot, provides a relatively compact and lightweight terrain-engaging device which is easily attached to or removed from the boot or shoe. The terrain-engaging device or crampon has a platform including an upper surface with a footbed to receive the bottom of the front portion of a flexible boot or shoe, under the ball of the foot, such that the heel of the boot or shoe extends behind the platform. A plurality of teeth extend downwardly from edges of the platform, including left and right side teeth and at least two front teeth, the front teeth extending forward from the platform in an oblique manner such as in the front teeth of a conventional full-foot crampon. The device includes a harness assembly secured to the platform and extending laterally outwardly from forward and rear locations on the platform. This harness includes strap means for engaging over the top of a user's boot including generally over the arch region of the boot, with buckling means for engaging the strap means firmly on the boot.

The terrain-engaging cleat device preferably further includes a heel strap connected to the harness assembly, for extending around the back of the user's boot to connect to an opposite side of the harness, with a latch or buckle to secure the strap firmly around the boot.

In one preferred embodiment the platform and teeth comprise an integral stainless steel stamping, and this may include stiffener pleats in the bend areas where the platform extends down into the teeth, for added strength.

The harness assembly includes a web of flexible material secured to the platform, preferably to its bottom, and extending laterally outwardly and upwardly from the platform. Portions of the web at each side of the crampon extend from positions both forward of and behind the side teeth. The strap means are connected to the web.

In preferred embodiments the platform has a tail extension at its rear, defining a rear attachment point located approximately at the arch of the user's shoe or boot. The web of the harness assembly, secured to the platform, has a rear portion secured to the rear attachment point on the tail extension. This provides a more secure binding to the boot, resisting rotation of the cleat relative to the boot.

An important aspect of the invention is a toe area terrain-engaging cleat or crampon in combination with a snowshoe which accepts the boot-worn cleat in a step-in arrangement, so that the user can quickly switch from simply using the terrain engaging cleat to wearing a snowshoe. This function and the structure which accomplishes the function are similar to the apparatus disclosed in the copending application Ser. No. 9,948, incorporated herein by reference, and this is one form of the invention. However, the invention also encompasses another embodiment of a snowshoe/crampon combination using the soft-boot cleat or crampon described above. In this case the snowshoe does not have a deck opening in a rear area for rear crampon teeth, since the terrain-engaging cleat of the invention resides only in the toe area of the boot. The front portion of the snowshoe has a registry plate which is easily engaged by the cleat even while it is worn on the boot, without the registry apparatus being directly visible to the user. The front teeth of the terrain-engaging cleat are angled downwardly and forwardly, and these provide a tactile means for finding the associated apparatus on the snowshoe plate for correct registry. If the user fails to step into precisely the right position, this will be readily apparent because the cleat will not feel as if it is being lowered into the snowshoe for proper engagement.

In a preferred embodiment, the snowshoe has a pivoting front harness, which may be biased to the tail-down position of the snowshoe, the front harness including the rigid registry plate adapted to be received against the bottom of the cleat device and preferably a strap to extend over the top of the foot. The rigid plate has a specific shape designed to accommodate the pattern of teeth at the front end of the cleat device. The plate has a front portion which provides clearance at front and sides to receive teeth of the crampon down around the plate. The plate and the crampon structure are configured and sized in preferred embodiments such that the user must tip the toe of the boot and connected cleat device toe-down into the snowshoe to fit a front bar of the registry plate between teeth of the cleat; then, when the heel is rotated down, an angled tooth edge pivots under the front bar structure of the plate, the tooth structure becomes closely nested with the plate, and the front end of the cleat is thus locked in position against lifting from the plate. The configurations of the harness plate, and of the tooth structure, are such that the cleat device becomes oriented (with respect to rotation about a vertical axis) on the snowshoe as the teeth are inserted into the clearances and the heel is lowered.

Once the user has stepped the cleat and boot into the snowshoe as described, a single strap may be used to secure the boot down to the front harness assembly, preferably located approximately at the boot arch and extending over the top of the foot between the ankle and the ball of the foot. This strap preferably is mounted on the registry plate of the snowshoe harness.

It is thus among the objects of the invention to make more efficient the use of snowshoes and terrain-engaging cleats in traversing fields of ice and snow alternatively, by providing a snowshoe with a front harness plate configured to receive a terrain-engaging cleat or crampon in a step-in maneuver that enables very quick transition from ice trekking to snowshoeing. Another object is an efficiently used, lightweight terrain-engaging cleat for the ball area of the boot, with or without a snowshoe. These and other objects, advantages and features of the invention will be apparent from the following description of preferred embodiments, considered along with the accompanying drawings.

DESCRIPTION OF PREFERRED EMBODIMENTS

Figure 1:
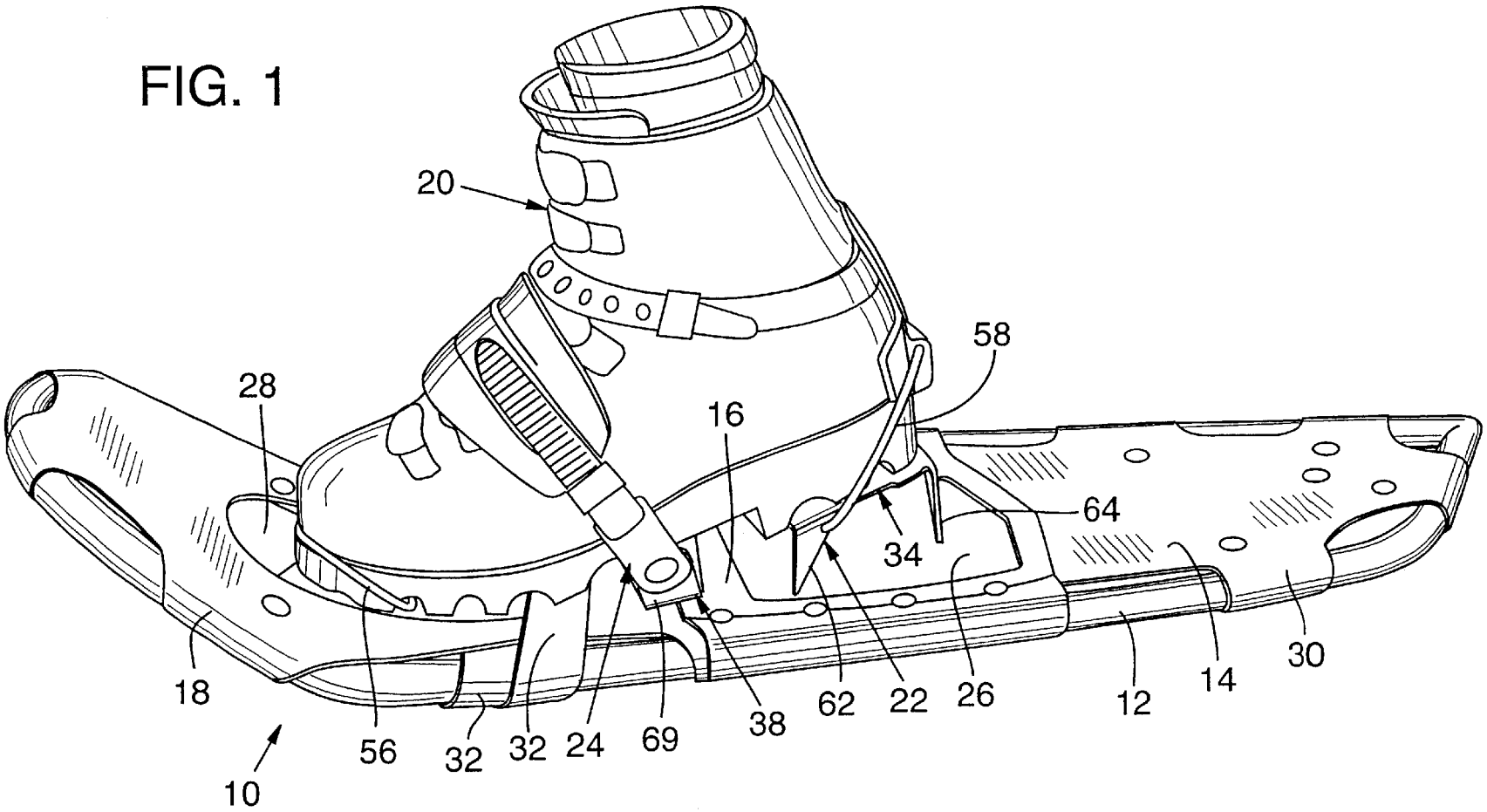
FIG. 1 is a perspective view showing a snowshoe with connected boot and crampon, in accordance with the principles of the invention.

FIG. 1 shows a snowshoe 10 having a frame 12 and deck portions 14, 16 and 18, in a first embodiment of a snowshoe/crampon combination. A boot 20 with an attached crampon or terrain-engaging cleat 22 is secured to the snowshoe by a front harness assembly of the snowshoe, generally identified by 24. As can be seen in the drawing, the snowshoe deck portions 16 and 18 have relatively large openings 26 and 28, and these accommodate rear and front groups of crampon teeth, as further explained below.

Figure 2:
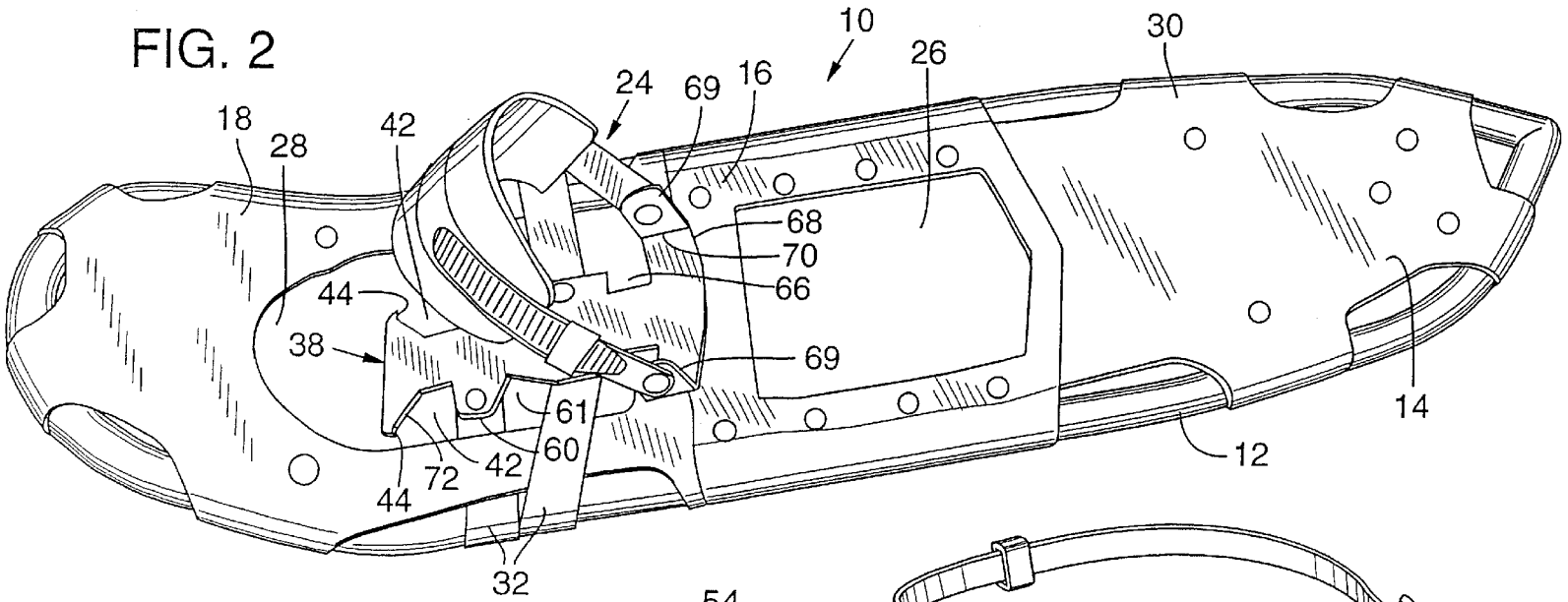
FIG. 2 is a perspective view showing the snowshoe alone.

FIG. 2 shows the snowshoe 10 alone. The decking areas 14, 16 and 18 in this preferred embodiment are retained to the snowshoe frame 12 by sections of decking material which extend around the frame and are riveted together to the main body of decking, as at 30, for example, and as shown in U.S. Pat. No. 5,440,827. The snowshoe's decking can be comprised of fewer pieces if desired.

As FIG. 2 reveals, the snowshoe 10 has a front harness assembly 24, preferably pivotable about a horizontal axis which can be provided by one or more resilient straps 32 wrapped around the frame and retaining the harness assembly preferably in a toe-down biased position, as shown in U.S. Pat. Nos. 5,253,437, 5,440,827, 5,699,630 and 5,687,491. However, the front harness and pivot assembly is without a front claw or cleat, nor does the snowshoe have any rear cleat. Instead, the open areas 28 and 26 provide space for a user wearing a boot and a crampon such as the crampon 22 to step into the snowshoe and lock the crampon to the snowshoe, after which the teeth of the crampon can be used as front and rear cleats for the snowshoe.

Figure 3:
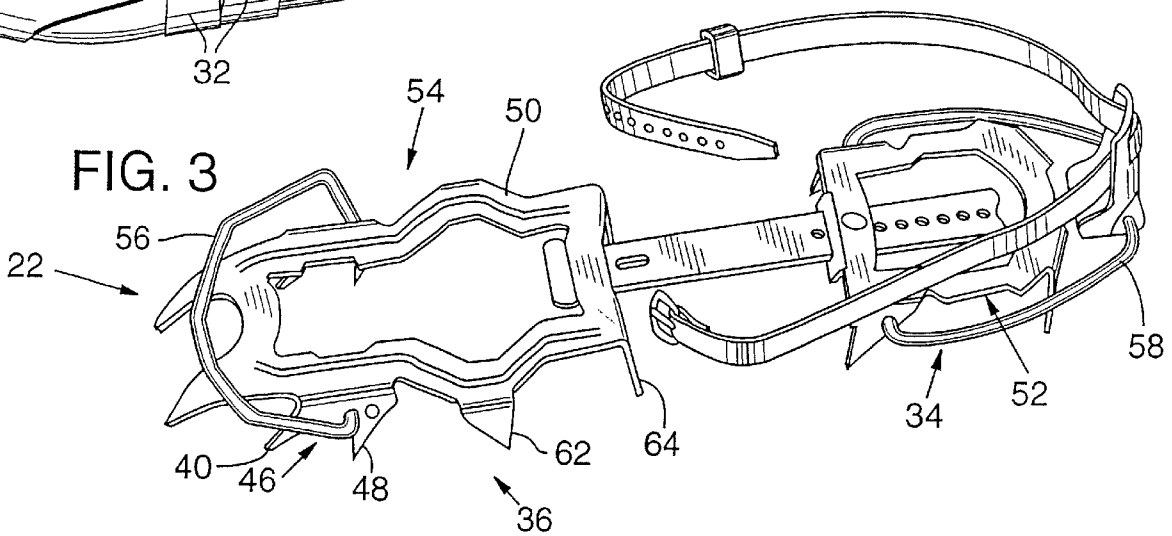
FIG. 3 is a perspective view showing a crampon of a type for use with the snowshoe of the invention.
Figure 6:
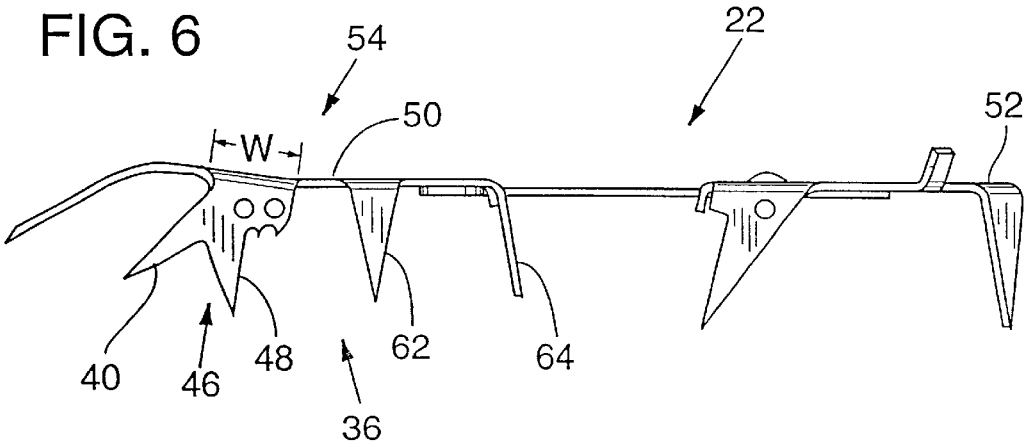
FIG. 6 is a side elevation view of a crampon as in FIG. 3.

FIGS. 3 and 6 show a crampon or terrain-engaging cleat 22 which is configured for use with the snowshoe of the invention. Important features of the cleat device 22 are that its rear group 34 of teeth is positioned to pass through the rear, generally heel-located opening 26 of the snowshoe, that its front group 36 of teeth is positioned to pass through the opening 28 at the front of the snowshoe, and that the front group 36 of teeth be configured to straddle over and engage with a front harness plate or registry plate 38 which is an important feature of the snowshoe. As seen in FIGS. 2 and 3, the crampon 22 can be attached to the snowshoe via the harness mounting plate 38, by simply stepping into the snowshoe in a toe-down position when the crampon is worn on the user's boot. With the strap assembly 24 in a loosened or released position, the user inclines the boot with the toe downward, at a steeper angle than the orientation of the mounting plate 38 itself, inserting a pair of opposed, left and right side teeth 40 (the left tooth 40 is visible in FIGS. 3 and 6) down through a clearance 42 provided at each side of a front portion of the mounting plate 38. The opposed crampon teeth 40 have inclined front surfaces so as to extend under tip structure 44 at each side of the front end of the mounting plate, the tip structures comprising a front bar across the front end of the plate 38.

The crampon teeth 40 each comprise a part of a side protrusion 46, which may also include another tooth 48 just behind the tooth 40, and which has a width W (FIG. 6) at its upper end, near a deck or frame 50 of the crampon, which is matched to the length of the clearance 42 in the harness plate 38. The forward side of the tooth 40, that is, of each side protrusion 46, is inclined forwardly/downwardly as shown, so that it engages under the structure 44 of the plate 38 and then locks the crampon in place after the crampon has been rotated such that its back end 52 is downward and the front portion 54, with the front group 36 of teeth, is in contact with the surface of the harness plate 38. FIG. 6 shows the crampon 22 in side view, with bales 56 and 58 removed (shown in FIG. 3). The illustrated crampon is of a known configuration, marketed as the Sabre Tooth crampon by Black Diamond Equipt. Ltd. of Salt Lake City, Utah.

Figure 5:
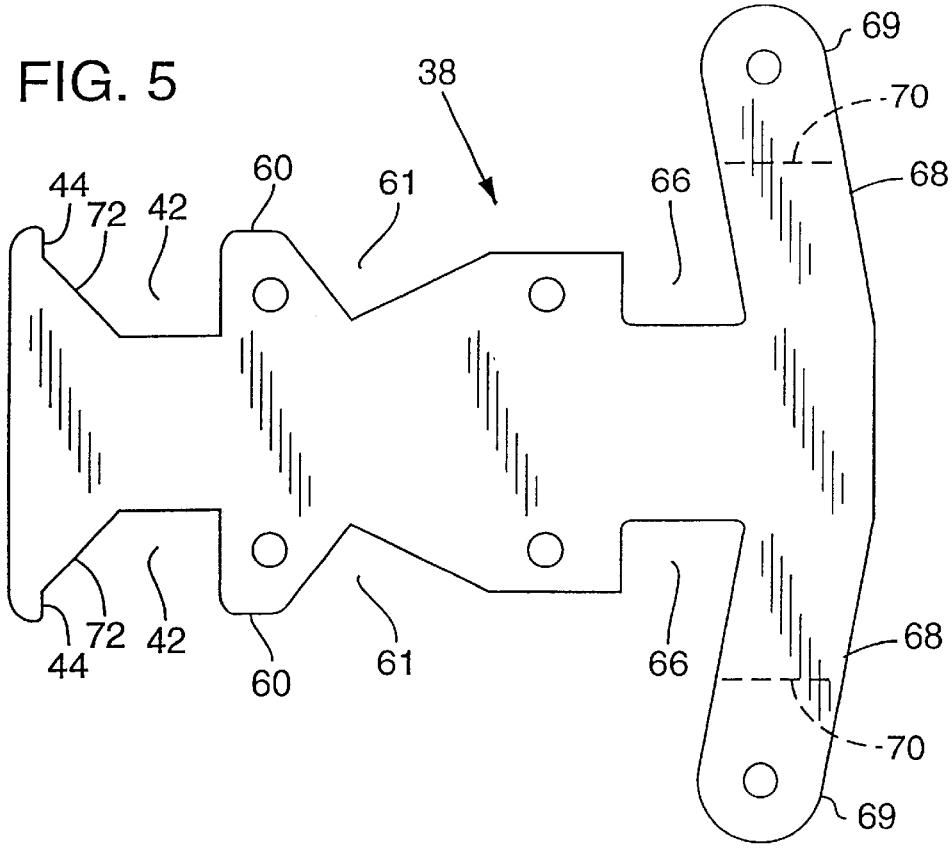
FIG. 5 is a plan view showing the plate of the harness assembly for the snowshoe of the invention.

FIG. 5 shows in plan, developed view the harness registry plate 38 which cooperates with the crampon 22. The clearance 42 at each side of the front end of the harness plate is shown as formed between the tip structure 44 and a wing extension 60 at each side, spaced back from the tips 44. The harness plate 38 in this embodiment is further configured to provide adequate spaces 61 for a further posterior pair of crampon teeth 62, still in the forward set 36 of teeth, as seen in FIGS. 3 and 6. Another pair of teeth 64, the most posterior of the forward set of teeth 36, are received in clearances 66 of the harness plate as shown in FIG. 5.

At the rear end of the harness plate 38 are a pair of arms 68, each of which has a tab 69 at its end, to be bent upward approximately at right angles along a line indicated by dashes 70 in FIG. 5. These tabs, as seen in FIG. 2, provide a mounting for the strap assembly 24 which extends over the user's boot after the user steps into the snowshoe with the crampon. The strap assembly 24 is adjustable, and preferably has a ratchet-type buckle known as a ladder lock buckle, of the type that tightens a strap by one or more notches in a rack of notches with each pivot stroke of a buckle lever, and which allows easy release by lifting the lever to a full-back position.

Figure 4:
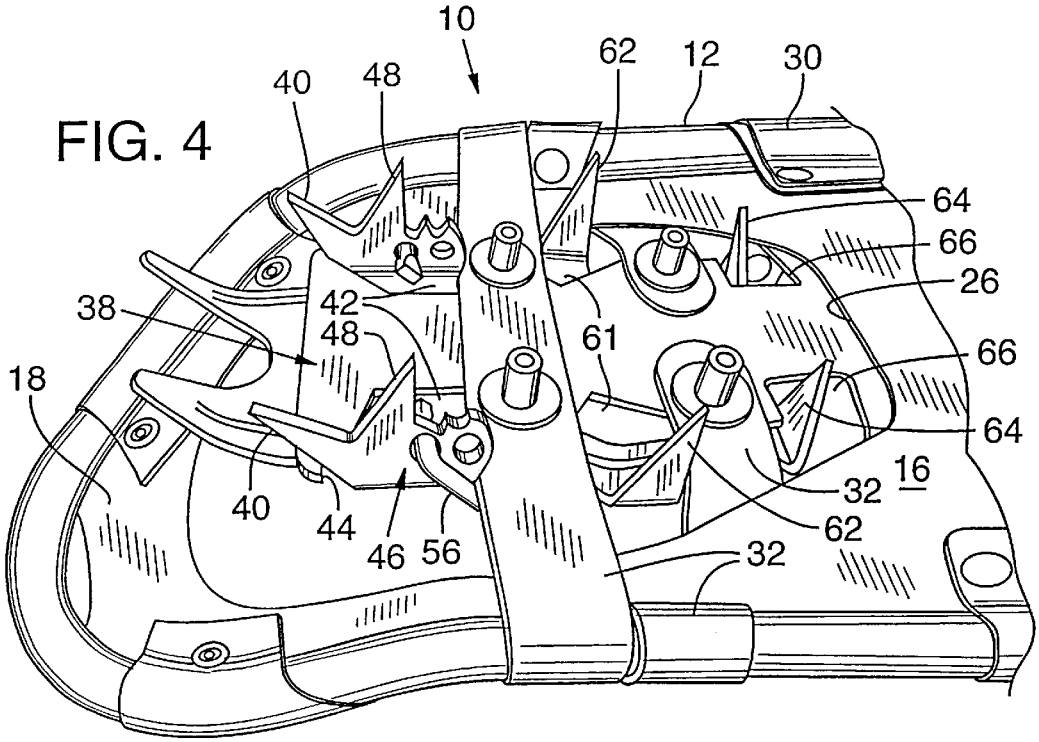
FIG. 4 is a perspective view showing the bottom side of the snowshoe's front harness assembly, with the crampon secured to the harness assembly.

FIG. 4, a bottom view of the snowshoe with the crampon attached, illustrates the engagement of the front end of the crampon with the snowshoe's harness assembly, and particularly with the harness plate 38. FIG. 4 reveals that the side protrusion 46 at each side of the crampon has been closely engaged within the clearance 42 at each side of the mounting plate 38. Also, the drawing shows the other pairs of teeth 62 and 64 as residing in the side clearances 61 and 66 of the harness plate. In this position the frame or deck 50 of the crampon is against the upper surface of the harness plate 38. The crampon teeth generally surround the plate 38, by which is meant that teeth extend down alongside the plate at least at front and sides.

As can be appreciated from FIG. 4, the act of stepping into the front harness of the snowshoe with the crampon teeth 40 engaging as discussed above and shown in the drawings, locates the crampon precisely relative to the harness assembly and the snowshoe, establishing proper rotational orientation between the crampon and the snowshoe, such that the snowshoe is firmly secured to the crampon against left or right rotation. For this purpose, as shown in FIG. 5 and also seen in FIG. 4, the mounting and registry plate 38 has angled surfaces 72 just aft of the tips 44, so that when the crampon teeth are inserted into and under the tips 44, these obliquely angled surfaces 72 guide the crampon into the precise position, particularly when the heel is rotated down to closely engage the crampon's side protrusions in the clearances 42.

FIGS. 7–12 show another form of terrain-engaging cleat or crampon 80 which can be used on a boot for enhancing traction such as in icy or semi-icy conditions, or in combination with a snowshoe wherein the device 80 provides a cleat for the snowshoe, as illustrated.

Figure 7:
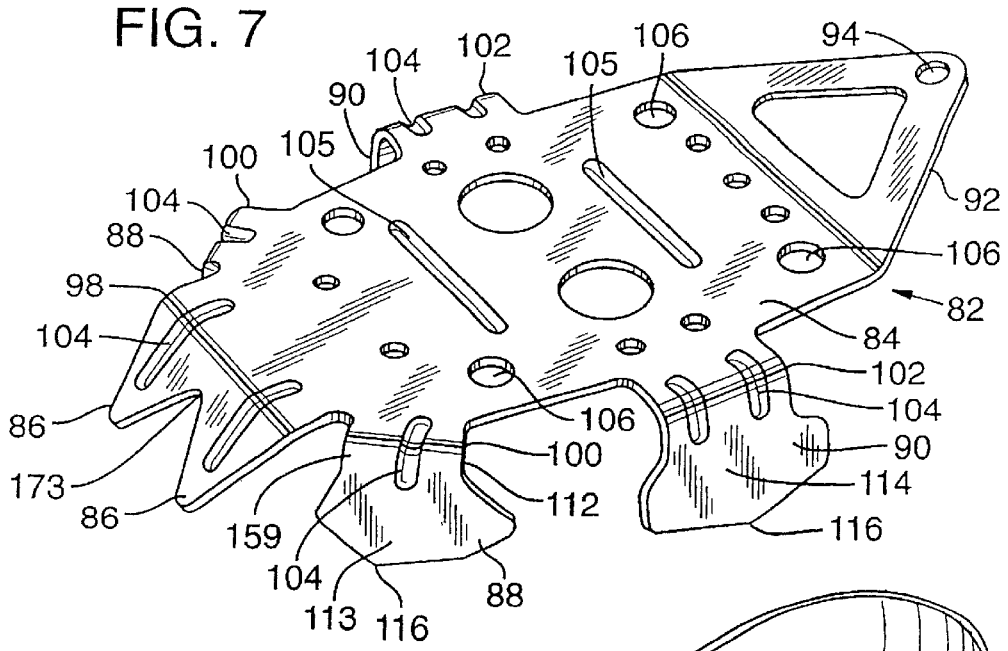
FIG. 7 is a perspective view showing a base portion of a terrain-engaging cleat or crampon according to another embodiment of the invention, for engaging only under the ball portion of the foot.
Figure 8:
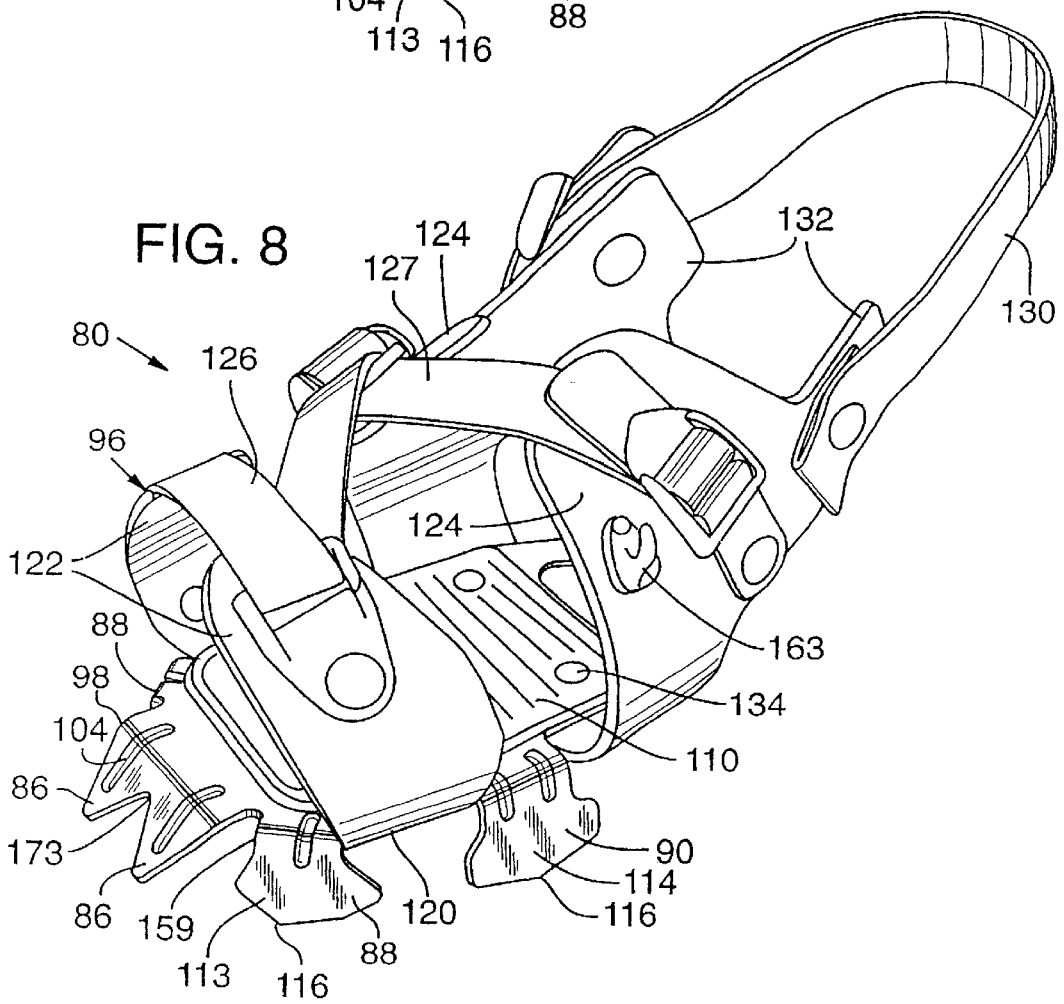
FIG. 8 is a perspective view showing a crampon assembly which includes the base portion shown in FIG. 7, along with a harness.

FIG. 7 shows a cleat plate or base plate 82 which is a principal component of the terrain-engaging cleat or crampon 80 shown in FIG. 8. The base 82 has a generally flat platform 84, a pair of front end teeth 86 integrally formed with and extending downwardly/forwardly from the platform 84, and further pairs of teeth 88 and 90. The two teeth 88 are angled teeth in this preferred embodiment, just aft of the two frontal teeth 86 as shown. The angled teeth 88 are angled relative to the forward/aft direction of movement of the crampon and relative to the transverse direction of the cleat device 82. Thus, these teeth 88 provide traction for the crampon in both the forward/back directions and in lateral directions.

The additional teeth 90 are side teeth, further aft on the crampon or terrain-engaging cleat. The base member also preferably includes a tail extension 92, defining a rear attachment point 94 for a part of the harness assembly 96 shown in FIG. 8.

The cleat base 82 in a preferred embodiment is formed as a stainless steel stamping. As shown, the teeth 86, 88 and 90 bend downwardly from edges of the platform 84, in bends 98, 100 and 102. Each of these bends may include a stiffener pleat 104, comprising an indentation formed into the metal for stiffening the teeth at each of these bends. Stiffener pleats are also shown at 105 in the platform 84.

The frontal teeth 86 are tapered, generally triangular as shown and are angled down about 45° in the embodiment shown. This angle preferably is between about 40° and 50°, or more broadly, between about 35° and 55°.

FIG. 7 also shows various holes through the deck or platform portion of the stamping 82, four of which identified as 106 are used for attaching a footbed 110 and the harness assembly 96 to the base 82. This can be a contoured footbed as in U.S. Pat. No. 5,687,491.

As also seen in FIGS. 7 and 8, each of the angled teeth 88 and the side teeth 90 comprises a relatively narrow neck 112, which extends from the platform 84 down through the bend 102, into a flat area 113, 114 of the tooth, substantially wider than the neck portion. The flat face area 113, 114 of the tooth, with its larger width, provides good gripping traction in penetrable terrain. As seen in the drawings, the maximum width of this flat face area, in each tooth 88 and 90, preferably is at least 50% wider than the narrower neck 112.

The drawings also show that each tooth 88, 90 defines a point 116 at its bottom, for engaging ice when encountered. Importantly, these ice points 116 are substantially directly beneath the stiffener pleats 104, so that if the terrain-engaging device 80 is used on rigid ice, the stress of supporting the weight of the user through the bends 100, 102 in the base portion is efficiently resisted by the stiffeners.

Figure 9:
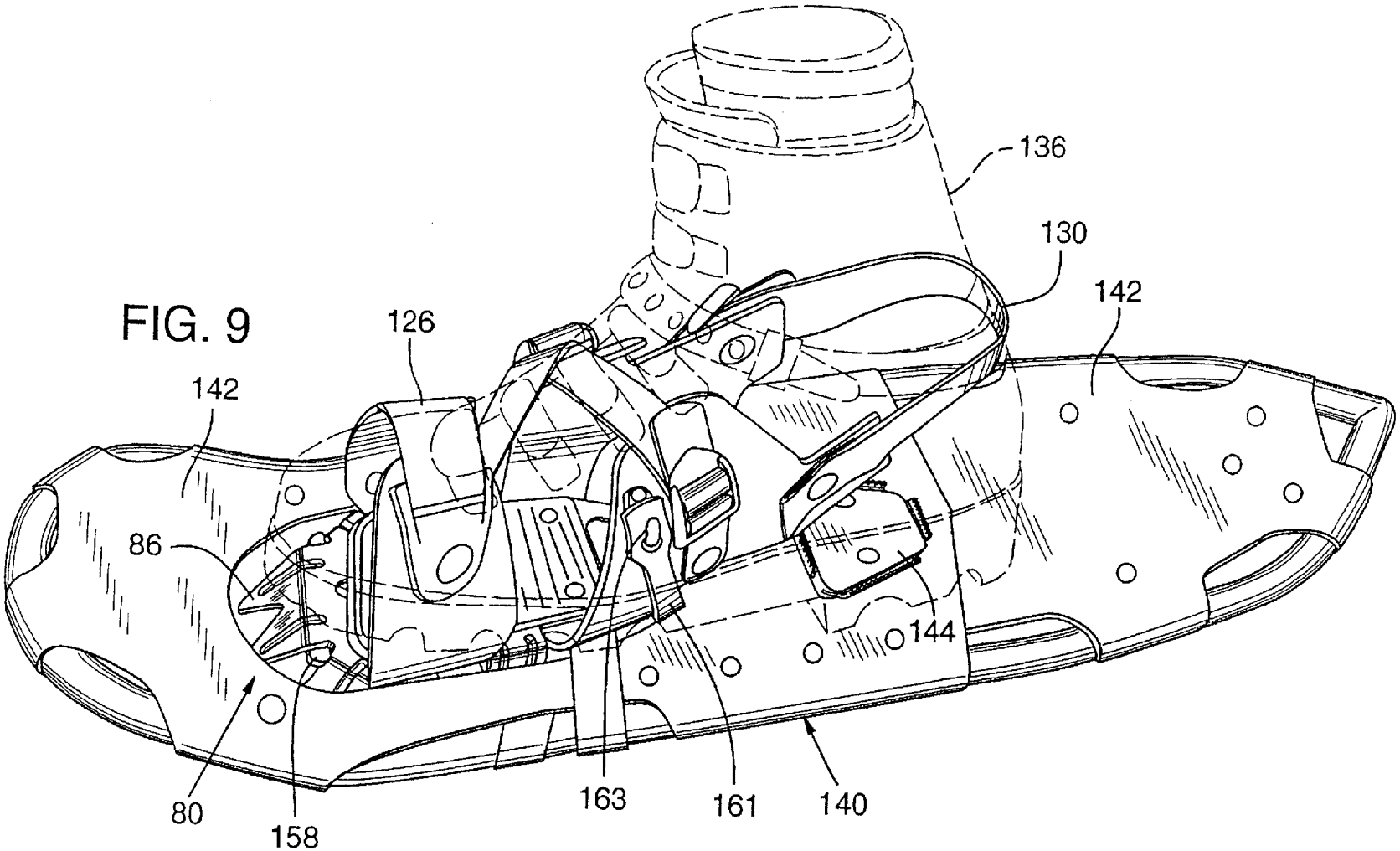
FIG. 9 is a perspective view showing the crampon of FIG. 8 as attached to a user's boot, and engaged in a snowshoe designed to receive the crampon.

The assembled terrain-engaging cleat device or crampon 80 as shown in FIG. 8 has a harness assembly 96 which can be similar to those produced by Atlas Snow-Shoe Company and incorporated as the front harness assembly of a snowshoe, such as on Atlas Models Nos. 1022 and 1033. The harness includes a web which has a central, bottom section or harness shell 120 that is secured to the metal platform 84, preferably being positioned beneath the platform 84 as shown. With reference to all of FIGS. 7–12, this harness 96 has forward harness legs 122 and rear harness legs 124 extending up and outwardly from the harness shell 120, as shown. These discrete legs of the harness web are positioned to extend over the ball of the foot, or essentially between the toe area and the ball area, with the legs 122; and from the arch area or slightly forward of the arch area, over the top of the foot generally as seen in FIG. 9. Straps 126, 127 extend between the webs to closely retain the web and the crampon device 80 on the foot. These straps 126 and 127, in a preferred embodiment, can comprise a single strap connected in a "Z" type arrangement as described in copending application Ser. No. 10,199, filed Jan. 21, 1998 and incorporated herein by reference. As in that copending application, the strap arrangement employed in the crampon device 80 provides for easy adjustment and quick and easy attachment of the crampon or cleat device 80 to the shoe or boot.

In addition, there is preferably included a heel strap 130 for increased stability and torsion resistance, this strap preferably extending from rear extensions 132 of the harness web 96.

As seen in the drawings, the tail extension 92 and rear attachment point 94 of the main base member 82 (FIG. 7) is important in providing an attachment point as far back on the crampon device 80 as needed for good binding and stability. That rear attachment point 94 is located in the arch area of the boot, slightly forward of the heel, as can be seen in FIG. 9.

As indicated in the drawings, the footbed 110 can be secured to the base member 82 by rivets 134, but also by gluing. The rivets 134 also serve to secure the harness shell 120 to the platform 84 of the metal base member 82.

Figure 10:
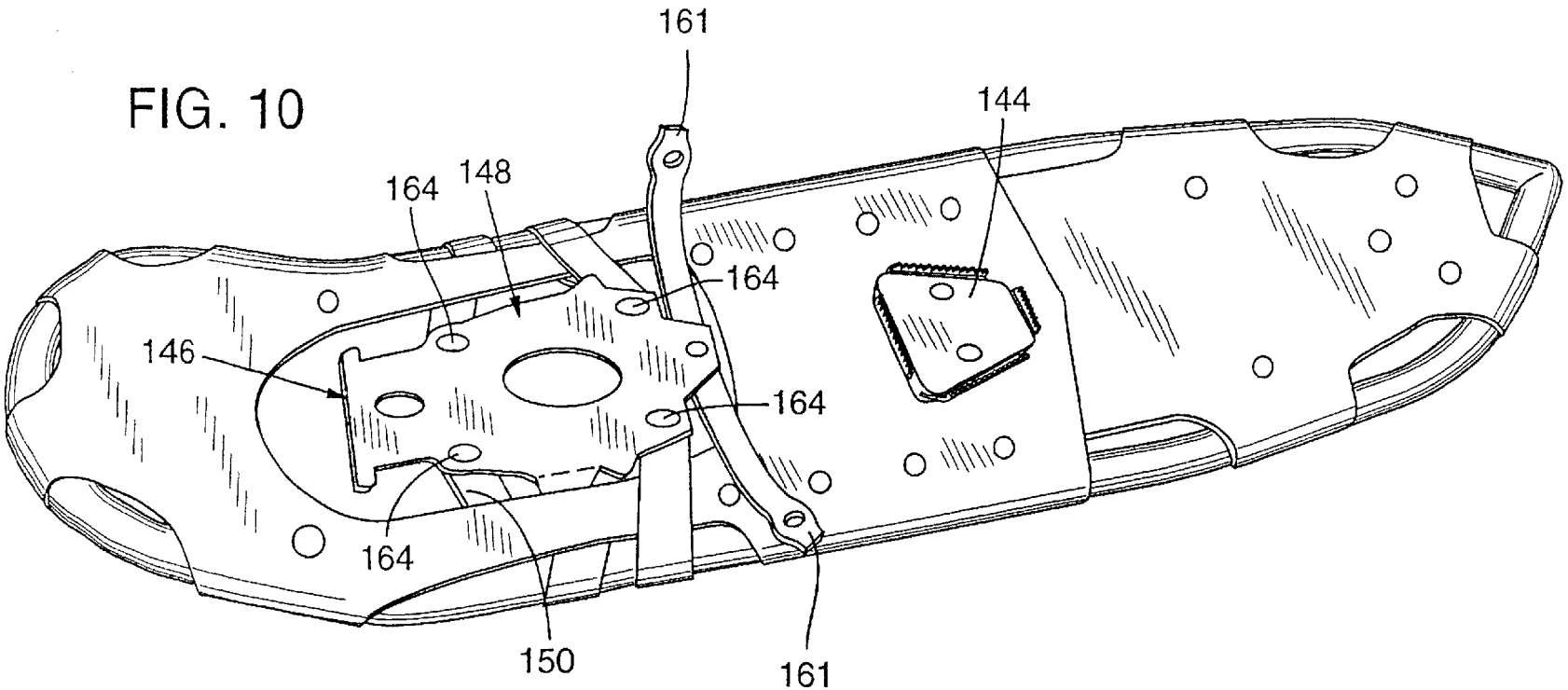
FIG. 10 is a perspective view showing the snowshoe of FIG. 8, without the crampon.

FIG. 9 shows the user's shoe or boot 136, wearing the crampon device 80 of the invention, and also engaged in a snowshoe 140. As also seen in FIG. 10, the snowshoe has decking 142 which preferably includes a rear cleat at 144 (the cleat actually extends below the decking), and the snowshoe has a front boot binding assembly 146 that includes a registry plate 148 for the crampon, which may be supported on tensioned straps 150 that afford a biased pivoting movement of the toe, and which includes a single strap 152 for extending over the top of the foot area of the boot, but which does not include a front cleat. See also FIGS. 11A–12. The terrain-engaging cleat or crampon 80 of the invention supplies the front cleat, since the teeth 86, 88 and 90 extend down and around the registry plate 148. This is similar to the registry of the front portion 54 of the full-foot crampon 22 into a snowshoe in the earlier described embodiment.

Figure 11A:
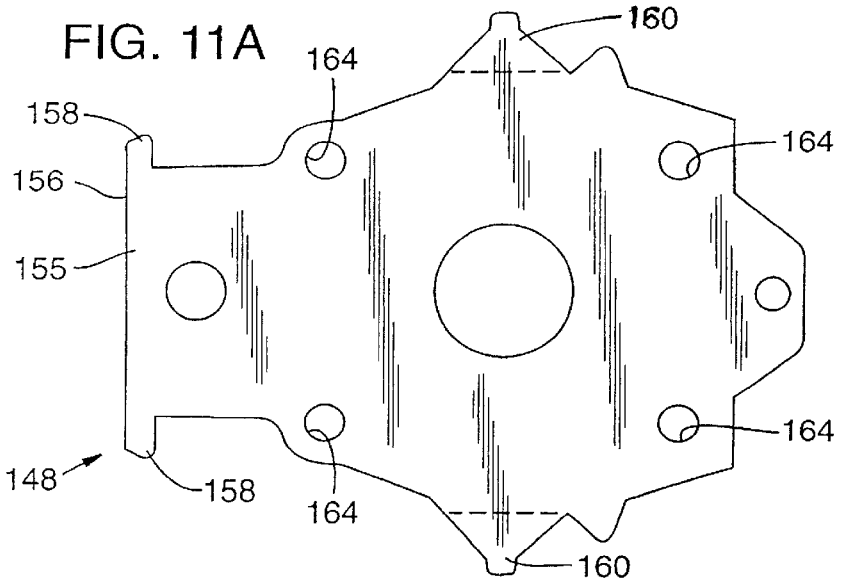
FIGS. 11A and 11B are plan and perspective views showing a registry plate which forms a part of the snowshoe of FIGS. 9 and 10.
Figure 11B:
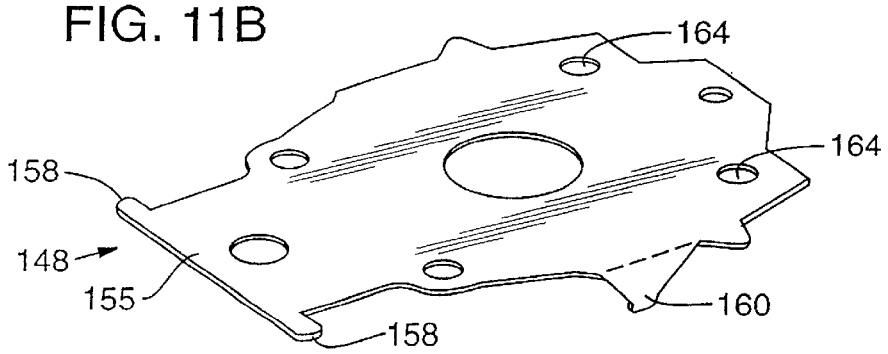
Figure 12:
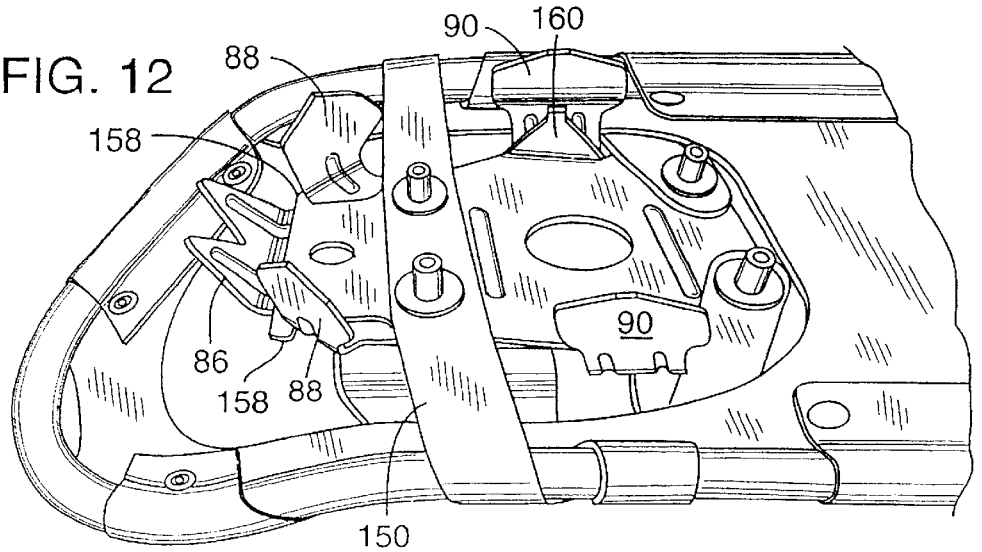
FIG. 12 is a bottom perspective view showing engagement between the registry plate of FIG. 11 and the cleat or crampon.

FIGS. 9–12 show one form of registry plate 148 for use with the crampon device 80 in this embodiment of the invention. FIGS. 13–15 show alternatives, described below. The registry plate 148 has a front bar 155 which extends across a forward end 156 of the plate and has extending tips 158 at left and right. These, as seen in FIGS. 9 and 12, are to be engaged between back sides of the front end teeth 86 and forward edges 159 of the angled teeth 88 that serve as protrusions similar to the protrusions 46 in FIGS. 3 and 4. Since the teeth 88 themselves are angled preferably downwardly and outwardly at an angle relative to the lateral and straight-ahead directions, this inclined forward edge 159 has a forward component to its orientation, so that when the front bar 155 is in place under the crampon, with the tips 158 between the teeth 86 and the inclined edges 159, the crampon cannot be lifted straight up at its front end, being confined by the front bar 155 interacting with the inclined edge 159. Thus, when the user wearing the crampon device 80 steps into the snowshoe, this must be done with the toe tipped downwardly, until the frontal bar 155 of the registry plate is correctly in position between the teeth 86 and the teeth 88. At that point, the user can pivot the foot downwardly onto the plate, then attach a pair of straps 161 to the harness via securing hooks 163, as seen particularly in FIGS. 8, 9 and 10. This is one preferred system for holding the boot down against the plate. The straps 161 can be of an elastic polymer that flexes somewhat but exerts enough force to keep the boot against the plate. By this arrangement the user can conveniently pull up on the two straps 161 and hook them on the hooks 163, avoiding additional straps over the top of the foot.

The registry plate 148 shown in FIGS. 11A and 11B, as well as in FIGS. 9, 10 and 12, has side stabilizers formed as projections 160 on each side, somewhat aft of the middle of the plate. These are bent downwardly (FIGS. 11B and 12) and positioned to engage against inner sides of the side teeth 90, and they are preferably located so as to engage between the stiffener pleats 104 on the base cleat device 82 shown in FIG. 7. When the user engages the front bar 155 in place, with the toe of the boot and crampon tipped down, and positions the front bar correctly between the crampon teeth 86 and 88, then rotates the foot downwardly, these side stabilizers 160 then engage inside surfaces of the teeth 90 to lock the cleat in place on the registry plate 148.

From FIGS. 10 and 11A–B can be seen one preferred method of securement of the registry plate 148 to the snowshoe. The plate has holes 164 through which rivets pass to secure the plate to the snowshoe's tensioned front straps 150, as in FIG. 10. The tensioned straps 150 in this embodiment are spaced apart sufficiently to allow the side teeth 90 of the crampon device (FIGS. 7 and 8) to pass down between the straps, one such tooth at each side of the registry plate 148. This is best seen in the bottom view of FIG. 12, which also reveals the side stabilizers 160 as engaging against inside surfaces of the side teeth 190. This tight engagement is made as the wearer rotates the cleat down onto the registry plate 148.

Figure 13A:
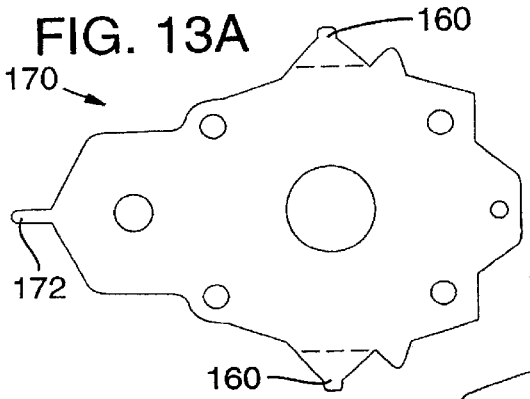
FIGS. 13A–15B are developed plan views and perspective views showing three additional types of registry plates which can be used in lieu of the plate shown in FIGS. 9–12.
Figure 13B:
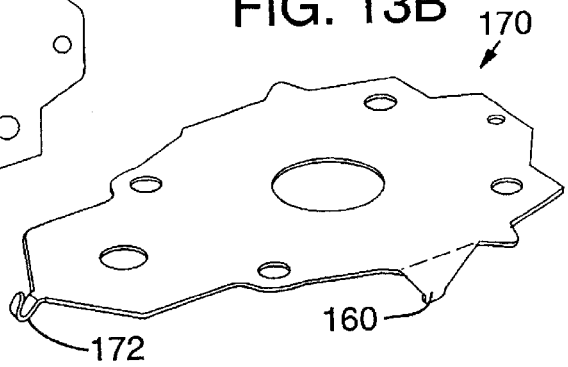

FIGS. 13–15 show alternative configurations of registry plates 170, 180 and 190. In FIGS. 13 and 13A, the registry plate 170 is quite similar to the plate 148, except at the front end. There, a front finger 172 extends forwardly and is formed into a somewhat downwardly dipping hook, in position to be engaged in a V notch 173 between the front teeth 86 of the crampon, as seen particularly in FIG. 7. This helps the user place the crampon correctly on the registry plate, since the registry plate is not visible beneath the foot and boot. With the central hooked finger 172 extending forward as a tactile guide, the user can feel it between the frontal crampon teeth 86, in the notch 173, then step down with the toe, causing the hooked finger 122 to shift the cleat's frontal teeth 86 left or right as needed and back against the front to position the front of the cleat correctly. Again, side stabilizers 160 center the aft parts of the cleat or crampon by engagement between the structure of the side teeth 90 as the foot is rotated down. Although not shown in FIGS. 13A–13B, the plate 170 can have a front bar similar to the front bar 155 of FIGS. 11–12, in addition to the hook 172.

Figure 14A:
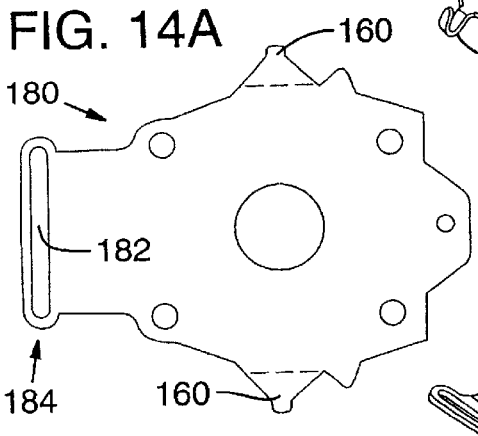
Figure 14B:
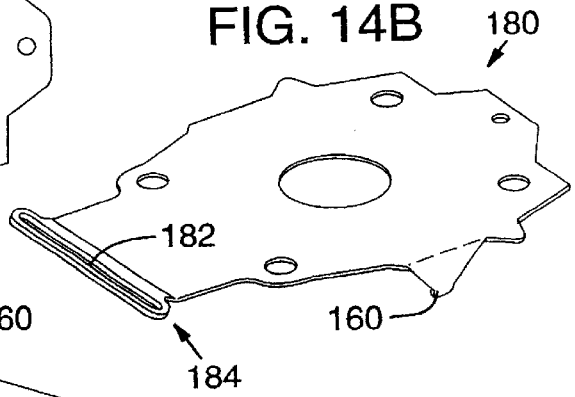

FIGS. 14A–B again show a registry plate 180 which is similar to the plates 148 and 170, except at the front end. Here, a slot 182 is formed by front end structure 184, and this slot is positioned to receive the frontal crampon teeth 86. Again, this gives a tactile indicator for the user to locate the front of the pleat or crampon correctly, prior to rotating the arch of the foot downwardly to engage the crampon with the outboard side stabilizers 160. In this case, the user again preferably tips the crampon down slightly, to best insert the frontal teeth 86 down through the slot 182, prior to rotating the arch downward. As indicated, the front end structure 184 on this plate 180 preferably is angled upwardly somewhat, to better catch the frontal teeth 86. If the user is off-center with the crampon, the tapered outside edges of the teeth guide the crampon to the correct position.

Figure 15A:
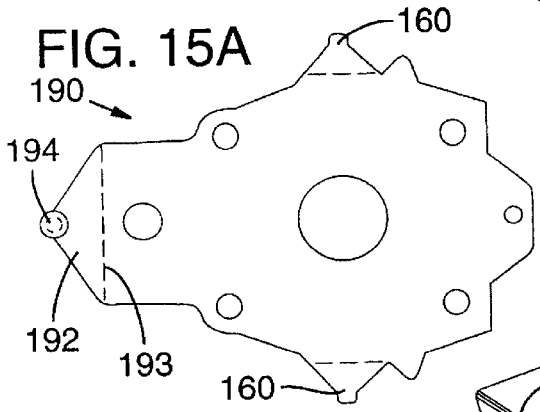
Figure 15B:
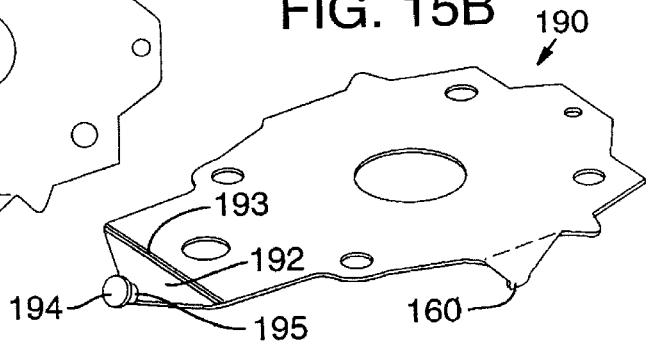

FIGS. 15A–B show a registry plate 190 which is again similar to the other plates described above in many respects. At the front of the registry plate 190 is a tapering frontal apex 192 with a raised disk 194 similar to a rivet head, spaced upwardly by a narrow neck 195 from the surface of the frontal apex 192. The frontal apex 192 is angled downwardly from a bend 193. Again, a tactile indicator is provided for the user in placing the toe end of the cleat or crampon 80 correctly. The frontal teeth 86 of the crampon are moved downwardly and forwardly against the neck of the rivet head or locator disk 194, such that the neck 195 of the disk becomes positioned in the V notch 173 between the frontal teeth 86. As in the last described embodiment, even if the user holds the foot laterally left or right to some extent, the downward engagement of the frontal teeth 86 will become self-centering of the crampon relative to the registry plate 190.

Figure 16:
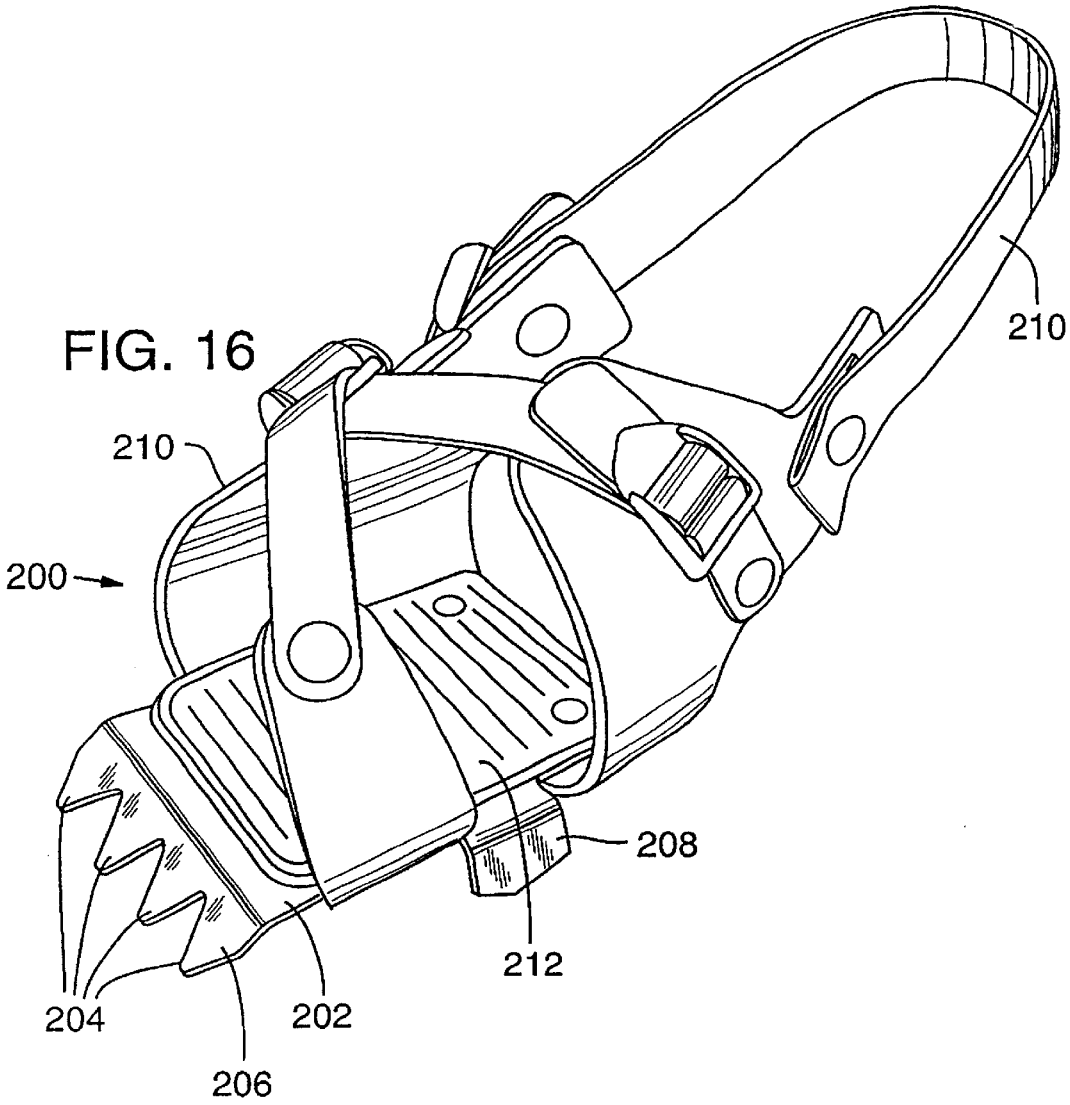
FIG. 16 is a perspective view showing another modified form of terrain-engaging cleat or crampon according to the invention.

FIG. 16 shows another embodiment of a terrain engaging cleat or crampon 200 according to the invention. This cleat or crampon 200 is similar in many respects to the previously described crampon 80, but employs a different cleat base 202, not specifically designed to engage with a snowshoe. The simpler cleat base 202 has a rack of front teeth 204, positioned at the bottom of a downwardly/forwardly angled frontal bend 206, and has a pair of side teeth 208. Its harness 210 may be essentially the same as described previously, but in this embodiment the crampon omits the tail extension 92 (FIG. 7) of the earlier embodiment, thus providing a less bulky terrain-engaging cleat or crampon. The crampon device 200 includes a rear strap 210 for extending around the back of the user's boot or shoe. Again, a footbed 212, which may be a flexible, rubbery footbed and which may be contoured as in U.S. Pat. No. 5,687,491, is secured down to the platform of the cleat base 202.

The above described preferred embodiments are intended to illustrate the principles of the invention, but not to limit its scope. Other embodiments and variations to this preferred embodiment will be apparent to those skilled in the art and may be made without departing from the spirit and scope of the invention.

I claim:

1. A terrain-engaging cleat or crampon for enhancing traction on a flexible boot or shoe, comprising:

a platform including an upper surface with a footbed of size and configuration to receive the bottom of a front portion of a flexible boot or shoe, under the ball of a user's foot, such that the heel of the boot or shoe extends behind the platform, the platform having a forward end and a back end, and the cleat or crampon being without any further platform surface for engagement with the bottom of a user's boot behind said back end, a plurality of teeth extending downwardly from edges of the platform, including left and right side teeth and at least two frontal teeth, the frontal teeth extending forward from the platform and lying in at least one plane which is obliquely angled relative to the platform, and including an angled tooth on each side of the crampon, between the side tooth and the frontal teeth, each angled tooth having a generally flat face that is angled obliquely relative to a line between the forward and back ends of the platform of the crampon such that the angled teeth afford traction for the crampon in both the forward/back direction and in lateral directions, the platform and teeth being integrally formed together of a stainless steel stamping, and wherein each angled tooth comprises a neck extending down through a bend from the edge of the platform, with a stiffener pleat formed in the bend, extending from the platform down into the flat face of the tooth for increased strength through the bend, and the flat face of the tooth being substantially wider than the neck portion, and the angled tooth being formed into an ice-engaging point at a bottom edge of the tooth, the point being essentially directly beneath the stiffener pleat so that stress in the angled tooth from the user's weight bearing on the crampon is resisted by the stiffener pleat, and a harness assembly secured to the platform, extending laterally outwardly from forward and rearward locations on the platform, and including strap means for engaging over the top of a user's boot including generally over an arch region of the boot, with strap connecting means for engaging the strap means firmly on the boot.

2. A snowshoe and crampon combination including:

(a) a terrain-engaging cleat or crampon for enhancing traction on a flexible boot or shoe, the cleat or crampon comprising:

a platform including an upper surface with a footbed of size and configuration to receive the bottom of a front portion of a flexible boot or shoe, under the ball of a user's foot, such that the heel of the boot or shoe extends behind the platform, a plurality of teeth extending downwardly from edges of the platform, including left and right side teeth and at least two frontal teeth, the frontal teeth extending forward from the platform and lying in at least one plane which is obliquely angled relative to the platform, and a harness assembly secured to the platform, extending laterally outwardly from forward and rearward locations on the platform, and including strap means for engaging over the top of a user's boot including generally over an arch region of the boot, with strap connecting means for engaging the strap means firmly on the boot, and (b) a snowshoe, the snowshoe having a snowshoe frame and a decking secured to the frame, with a registry plate connected to the frame and positioned generally where a toe or ball area of the user's boot is to be located when the snowshoe is worn by a user, with open space in the snowshoe decking at least in areas to front and sides of the registry plate, said teeth of the crampon including teeth so arranged to generally extend down alongside the crampon registry plate and to extend downwardly through said space and beneath the plate to engage terrain when the crampon is engaged against an upper surface of the plate, and the registry plate and the crampon including cooperating means for substantially locking the crampon in position on the registry plate against relative shifting movement and twisting movement, whereby the crampon may be worn on the user's boot for ice conditions, without the snowshoe, and when deep snow is to be traversed by the user, the boot and crampon can be secured directly and securely to the snowshoe, the crampon thus providing a cleat for the snowshoe.

3. The snowshoe and crampon combination of claim 2, wherein the registry plate has lateral extensions positioned to engage between teeth of the crampon when the crampon is lowered down onto the registry plate.

4. The snowshoe and crampon combination of claim 2, wherein the registry plate has crampon-engaging structure, and including means cooperating between the crampon-engaging structure and the crampon teeth for engaging the teeth of the crampon with the crampon engaging structure so as to center the crampon on the registry plate as the user steps the crampon down onto the registry plate.

5. The snowshoe and crampon combination of claim 4, wherein the means for engaging the teeth includes means within said structure of the registry plate for engaging with the frontal teeth of the crampon, the frontal teeth being tapered and generally triangular in shape.

6. The snowshoe and crampon combination of claim 5, wherein the frontal teeth are two in number, and the means for engaging the teeth comprising structure positioned to engage between the two frontal teeth.

7. The snowshoe and crampon combination of claim 5, wherein said crampon-engaging structure of the registry plate comprises a lateral slot configured to receive the frontal teeth of the crampon through the slot as the toe end of the crampon is lowered down onto the plate.

8. A snowshoe and crampon combination, comprising:

a snowshoe including a snowshoe frame and a decking secured to the snowshoe frame, the snowshoe further including a crampon registry plate positioned generally where a toe or ball area of the user's boot is located when the snowshoe is worn by a user, with open space in the snowshoe decking around portions of the registry plate, a terrain-engaging cleat or crampon with means for engagement with the user's boot and for securing the crampon to the boot so as to be useful in enhancing traction for the user independent of the snowshoe, the crampon having a series of downwardly extending teeth, including teeth so arranged to generally extend down alongside the crampon registry plate and to extend downwardly through said open space and beneath the plate to engage terrain when the crampon is engaged against an upper surface of the plate, and the registry plate and the crampon including cooperating means for substantially locking the crampon in position on the registry plate against relative shifting movement and twisting movement, whereby the crampon may be worn on the user's boot for ice conditions, without the snowshoe, and when deep snow is to be traversed by the user, the boot and crampon can be secured directly and securely to the snowshoe, the crampon thus providing a cleat for the snowshoe.

9. The apparatus of claim 8, wherein the snowshoe further includes securing means connected to the registry plate for preventing uplifting of the user's boot and crampon from the plate.

10. The apparatus of claim 9, wherein the crampon registry plate is mounted for rotation relative to the snowshoe about a generally transverse horizontal pivot axis on the snowshoe, including bias means urging the registry plate toward a position about said axis wherein the rear end of the snowshoe is tipped downwardly relative to the user's boot when the crampon is secured to the snowshoe.

11. The apparatus of claim 8, wherein the cooperating means for locking the crampon onto the registry plate comprises the crampon having frontal teeth which extend downwardly and forwardly from a front end of the crampon, and the crampon having side protrusions just aft of the frontal teeth and extending downwardly and each including a tooth angled downwardly and with a forward edge angled downwardly and forwardly, and the registry plate having a lateral front bar with a pair of left and right laterally extending tip structures each positioned to fit between one of the frontal teeth and one of the side protrusions such that the crampon can be engaged onto the registry plate by stepping the crampon down onto the plate with the crampon's frontal teeth positioned over and forward of the plate's front bar and such that the front bar nests between back sides of the frontal teeth and said forward edges of the side protrusions with the tip structures against said forward edges, when the crampon is engaged down flatly against the plate.

12. The apparatus of claim 11, wherein the registry plate further includes side stabilizers aft of the front bar and extending laterally outwardly and wherein the crampon includes side teeth aft of said side protrusions, the side stabilizers being positioned to engage and closely fit between the side teeth to properly register the crampon on the registry plate.

13. The apparatus of claim 8, wherein the cooperating means for locking the crampon onto the registry plate comprises the crampon having frontal teeth which extend downwardly and forwardly from a front end of the crampon, and the registry plate having front structure with means for engaging the crampon's frontal teeth so as to center the front of the crampon on the registry plate and to prevent upward movement of the crampon from the registry plate when the crampon is fully inserted thereon.

14. The apparatus of claim 8, wherein the cooperating means for generally fixing the crampon comprises the crampon having frontal teeth which extend downwardly and forwardly from a front end of the crampon, and the crampon having side protrusions just aft of the frontal teeth and extending downwardly and each including a tooth angled downwardly and with a forward edge angled downwardly and forwardly, and the registry means including a transverse member capable of fitting between one of the frontal teeth and one of the side protrusions at each side of the crampon such that the crampon can be engaged onto the registry means by stepping the crampon down onto the registry means with the crampon's frontal teeth positioned over and forward of the transverse member and the side protrusions positioned behind the transverse member such that said forward edges of the side protrusions engage against the transverse member to help fix the crampon against twisting movement on the snowshoe.

15. A snowshoe and crampon combination, comprising:

a snowshoe including a snowshoe frame and a decking secured to the snowshoe frame, a terrain-engaging cleat or crampon with means for engagement with a user's boot and for securing the crampon to the boot so as to be useful in enhancing traction for the user independent of the snowshoe, the snowshoe further including crampon registry means secured to the frame for receiving the crampon by stepping into the snowshoe with the crampon, the registry means being positioned generally where a toe or ball area of the user's boot is located when the snowshoe is worn by a user, with open space in the snowshoe adjacent to the registry means, the crampon having a series of downwardly extending teeth, including teeth so arranged to generally extend down alongside the crampon registry means and to extend downwardly through said open space and beneath the registry means to engage terrain when the crampon is engaged against the registry means, and the registry means and the crampon including cooperating means for generally fixing the crampon in position on the registry means against relative shifting movement and twisting movement, whereby the crampon may be worn on the user's boot for ice conditions, without the snowshoe, and when deep snow is to be traversed by the user, the boot and crampon can be secured directly and securely to the snowshoe, the crampon thus providing a cleat for the snowshoe.

16. The apparatus of claim 15, wherein the snowshoe further includes securing means connected to the registry means for preventing uplifting of the user's boot and crampon from the registry means.

17. The apparatus of claim 15, wherein the registry means is mounted for rotation about a generally transverse horizontal pivot axis on the snowshoe, and including bias means urging the registry means toward a position wherein the rear end of the snowshoe is tipped downwardly relative to the user's boot when the crampon is secured to the snowshoe.

18. A snowshoe and crampon combination, comprising:

a snowshoe including a snowshoe frame, a terrain-engaging cleat or crampon with means for engagement with a user's boot and for securing the crampon to the boot so as to be useful in enhancing traction for the user independent of the snowshoe, the crampon having a series of downwardly extending teeth, the snowshoe and crampon including steps-in means for engaging some of the teeth of the crampon with structure of the snowshoe at a toe or ball area of the user's boot so as to orient and position the crampon as the user steps into the snowshoe to thereby achieve lateral stability and torsional stability of the crampon relative to the snowshoe, and the snowshoe further including securing means for preventing uplifting of the user's boot and crampon from the snowshoe.

19. The apparatus of claim 18, wherein the securing means comprises a strap fixed to the snowshoe and capable of engaging with the user's boot to hold the toe end of the user's boot down against the snowshoe.

20. A method for use of a crampon worn on the toe or ball area of a user's boot, alone and in combination with a snowshoe in accordance with differing terrain conditions, comprising:

securing to the user's flexible boot or shoe a terrain-engaging cleat or crampon for enhancing traction, the cleat or crampon comprising:

a platform including an upper surface with a footbed of size and configuration to receive the bottom of a front portion of a flexible boot or shoe, under the ball of a user's foot, such that the heel of the boot or shoe extends behind the platform, unsupported by the cleat or crampon, a plurality of teeth extending downwardly from edges of the platform, including left and right side teeth and frontal teeth, and a harness assembly secured to the platform, extending laterally outwardly from forward and rearward locations on the platform, and including at least one strap positioned to engage over the top of a user's boot including generally over an arch region of the boot, with at least one strap connector for engaging the strap firmly on the boot;

using the crampon for walking on icy terrain conditions; and, when deep snow is to be traversed by the user, providing a snowshoe for attachment to the crampon, and stepping into the snowshoe with the crampon on the user's boot to engage the crampon with a registry member on the snowshoe, the registry member positioned generally where a toe or ball area of the user's boot is to be located when the snowshoe is worn by a user, with open space in the snowshoe at least in areas to front and sides of the registry member, said teeth of the crampon including teeth so arranged to generally extend down alongside the registry member and to extend downwardly through said space and beneath the registry member to engage terrain when the crampon is engaged against an upper surface of the registry member, and including substantially locking the crampon in position on the registry member against relative shifting movement and twisting movement; and traversing snow with the snowshoe attached to the crampon, the crampon thus providing a cleat for the snowshoe.

* * * * *